US007891991B2

(12) United States Patent
Zhang

(10) Patent No.: US 7,891,991 B2
(45) Date of Patent: Feb. 22, 2011

(54) CONTACT HAVING SOLDERED INTERCONNECTION BETWEEN FIRST AND SECOND PARTS

(75) Inventor: Han-Ming Zhang, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/625,577

(22) Filed: Nov. 25, 2009

(65) Prior Publication Data

US 2010/0173535 A1 Jul. 8, 2010

(30) Foreign Application Priority Data

Jan. 6, 2009 (CN) ..... 2009 1 0300072

(51) Int. Cl.
*H01R 12/00* (2006.01)

(52) U.S. Cl. ..... 439/79; 439/289; 439/891

(58) Field of Classification Search ..... 439/733.1, 439/668, 669, 589, 79, 947, 289
See application file for complete search history.

(56) References Cited

U.S. PATENT DOCUMENTS 4,992,055 A * 2/1991 Brummans et al. ..... 439/78
6,053,763 A * 4/2000 Brennan et al. ..... 439/491
6,322,396 B1 * 11/2001 Kuan ..... 439/607.01
6,524,130 B1 * 2/2003 Yeh ..... 439/541.5
6,918,799 B2 * 7/2005 Zhu et al. ..... 439/862
6,921,291 B2 * 7/2005 Shih ..... 439/541.5
7,717,755 B2 * 5/2010 Zhang et al. ..... 439/669
7,753,738 B2 * 7/2010 Zhang ..... 439/668
7,775,837 B2 * 8/2010 Zhang ..... 439/669
2010/0144195 A1 * 6/2010 Zhang ..... 439/541.5
2010/0173535 A1 * 7/2010 Zhang ..... 439/733.1
2010/0203767 A1 * 8/2010 Zhang ..... 439/660

* cited by examiner

*Primary Examiner*—Neil Abrams
*Assistant Examiner*—Phuong Nguyen
(74) *Attorney, Agent, or Firm*—Andrew C. Cheng; Wei Te Chung; Ming Chieh Chang

(57) ABSTRACT

An electrical connector includes an insulting housing, a mating face, a rear face opposite to the mating face, a first receiving groove defined into the mating face and a second receiving groove defined into the rear face, and the two receiving grooves extend towards each other. The first contact includes a contacting contact retained in the first receiving groove and a soldering contact separated from the contacting contact and retained in the second receiving groove, and the contacting contact defines a mating portion exposed to the mating face, and the soldering contact defines a soldering portion exposed out of the housing for mounting onto a printed circuit board and a resilient arm extending into the second receiving groove and soldered to the contacting contact. The separated mating contact and soldering contact are soldered together to provide a secure connection therebetween and a good electronic capability for the electrical connector.

20 Claims, 8 Drawing Sheets

CONTACT HAVING SOLDERED INTERCONNECTION BETWEEN FIRST AND SECOND PARTS

BACKGROUND OF THE INVENTION

1. Field of the Invention

The present invention relates to an electrical connector, and more particularly to an electrical connector having a contact configured with first and second parts interconnected with solder mass to ensure reliable and robust interconnection.

2. Description of the Related Art

With the trend toward miniaturization in computer technology, a good connection between electronic components is required. U.S. Pat. No. 6,524,130 issued to Yeh on Feb. 25, 2003 discloses an electrical connector including an insulative housing and a plurality of contacts retained in the housing. The contacts include a first contact which defines a mating portion and a first contacting portion extending from a bottom edge of the mating portion and a second contact which is separated from the first contact and defines a second contacting portion and a soldering portion extending from a free end of the second contacting portion. The second contacting portion is disposed thereunder and contacts to the first contacting portion to provide an electrically connection between the first and second contacts by the normal force resulted from the resilient property of the contact.

Since the interconnection between the first and second contacting portions is in way of face-to-face contact, while is not a permanent, such as a solder joint between the contact tail and the solder pad on the printed circuit board, sparks and oxidation can be readily created. Moreover, oxidation formed between the first and second contacting portions also will weaken the electrical connection between the first and second contacts, which will weaken the electrical interconnection of the electrical connector. Therefore, a new design to solve the problem is required.

SUMMARY OF THE INVENTION

An object of the present invention is to provide an electrical connector in which a solder joint is established between first and second parts of the contact so as to properly address the issue encountered by the prior art.

In order to achieve the above-mentioned objects, an electrical connector includes an insulative housing and a first contact received and retained in the housing. The housing defines a mating face, a rear face opposite to the mating face, a first receiving groove defined into the mating face and a second receiving groove defined into the rear face, and the two receiving grooves extend towards each other to communicate with each other. The first contact includes a contacting contact retained in the first receiving groove and a soldering contact separated from the contacting contact and retained in the second receiving groove, and the contacting contact defines a mating portion exposed to the mating face, and the soldering contact defines a soldering portion exposed out of the housing for mounting onto a printed circuit board and a resilient arm extending into the second receiving groove and soldered to the contacting contact.

Other objects, advantages and novel features of the invention will become more apparent from the following detailed description of the present embodiment when taken in conjunction with the accompanying drawings.

DETAILED DESCRIPTION OF THE INVENTION

Figure 1:
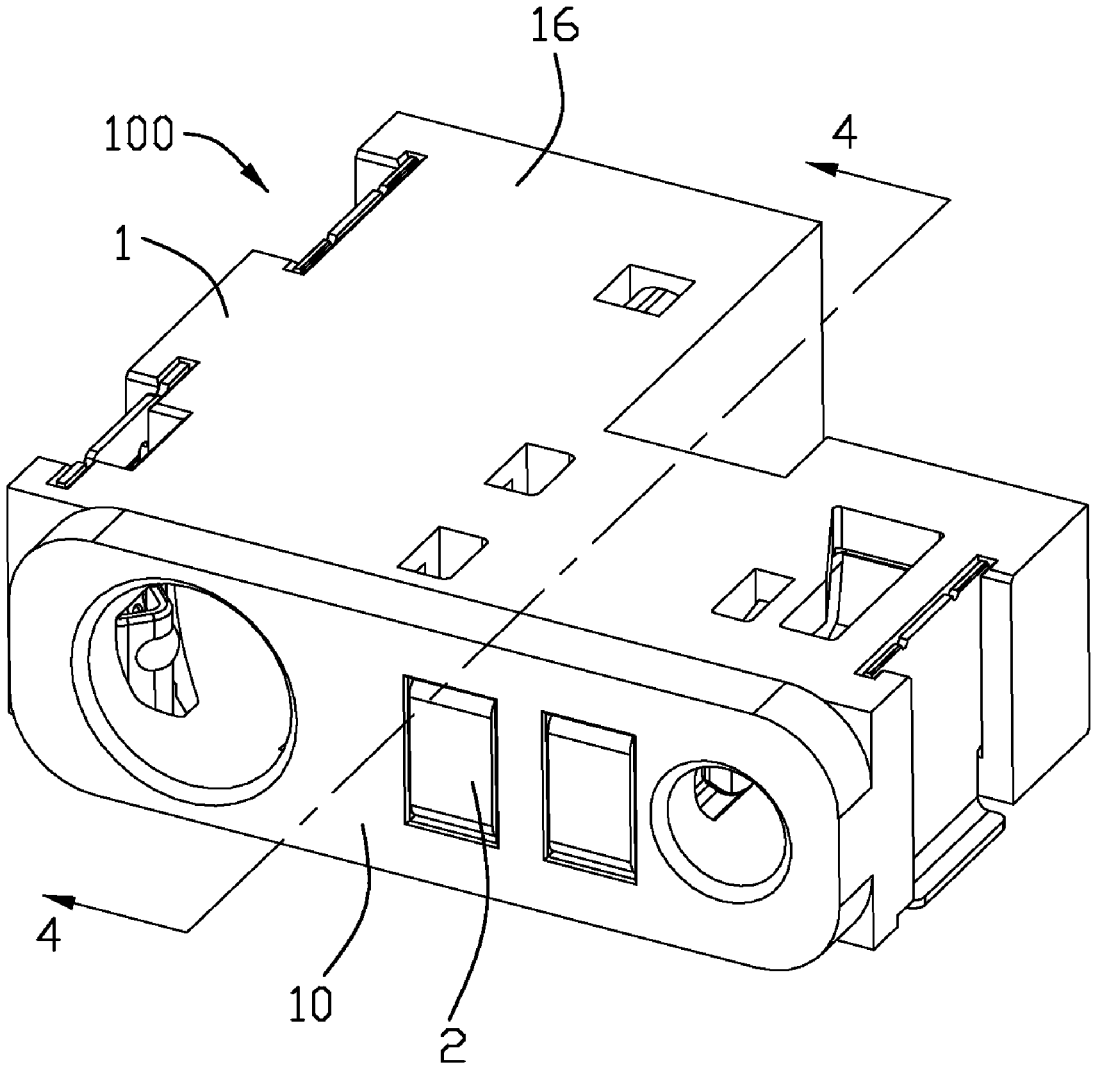
FIG. 1 is a perspective view of an electrical connector in accordance with the present invention.

Reference will now be made to the drawing figures to describe the preferred embodiment of the present invention in detail.

Figure 2:
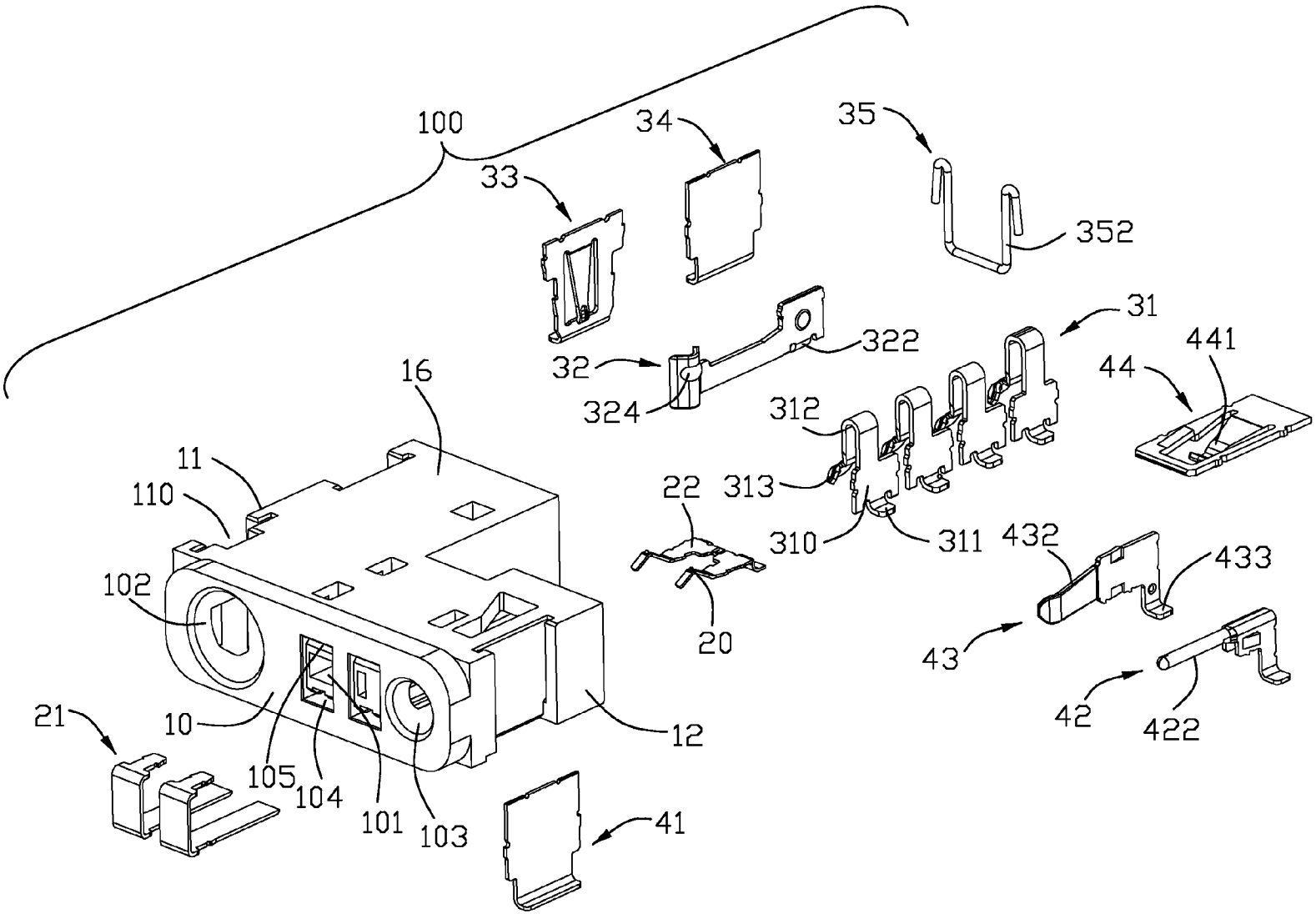
FIG. 2 is an exploded perspective view of the electrical connector shown in FIG. 1

Referring to FIG. 1 and FIG. 2, an electrical connector 100 includes an insulative housing 1, a plurality of electrical contacts received in the housing 1, retaining members 34, 41 for retaining the electrical connector to a printed circuit board (PCB) steadily and a clip member 35 retained in the housing for clipping a mating connector.

Referring to FIG. 2 to FIG. 4A, the housing 1 defines a front face or mating face 10, a rear face opposite to the mating face 10, a top face 16 perpendicular to the mating face 10, a bottom face or mounting face opposite to the top face 16 and a pair of sidewalls 13 perpendicular to the mating face 10 and bottom face. A pair of first contact receiving grooves 101 and a first and second receiving cavities 102, 103 are defined into the mating face 10, and the first contact receiving grooves 101 arranged side by side at a middle portion thereof, and the first and second receiving cavities 102, 103 are separately disposed at two sides of the two first receiving grooves 101, which allows the electrical connector to mate with three different types of mating connectors. The rear face defines a first rear face 13 opposite to the first receiving grooves 101, a second rear face 14 opposite to the first receiving cavity 102 and a third rear face 15 opposite to the second receiving cavity 103, and the three rear faces 13, 14, 15 are disposed in different plane for miniaturization. The first receiving cavity 102 further runs through the second rear face 14 and provides a through hole 141 thereof. Each first receiving groove 101 defines a retaining slot 104 adjacent to the mounting face and a retaining groove 105 adjacent to the top face 16. The housing 1 further defines a pair of second receiving grooves each recessing forwards from the first rear face 13 and defining a retaining portion 131 and a receiving portion 132, and the receiving portion 132 is disposed above the retaining portion 131 and communicates with the first receiving groove 101.

Figure 5:
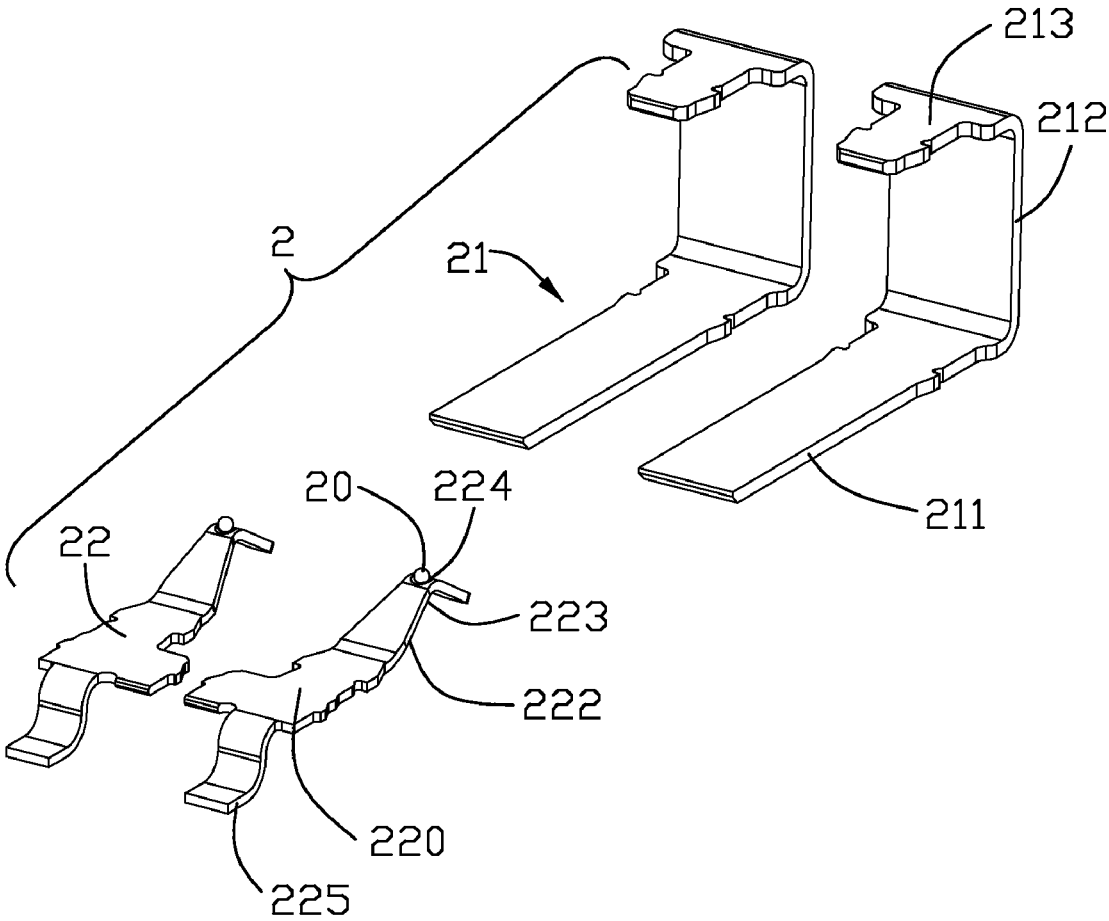
FIG. 5 is a perspective view of a first set of contact of the electrical connector shown in FIG. 1.

Referring to FIG. 2 and FIG. 5, the plurality of contacts include a pair of first contacts 2 each defining a contacting contact 21 and a soldering contact 22. Each contacting contact 21 defines a blade-shaped connecting portion 211, a mating portion 212 extending upwards from a front end of the connecting portion 211 and a fixing portion 213 bending rearwards from an upper side of the mating portion 212. The mating portion 212 is perpendicular to the connecting portion 211, and the fixing portion 213 is parallel to the connecting portion 211. The soldering contact 22 defines a base portion 220, a resilient arm 222 extending forwards and upwards from a front end of the base portion 220 and a soldering portion 225 extending rearwards and downwards from a rear end of the base portion 220. A contacting portion 223 is defined at a free end of the resilient arm 222 by bending upwards, with a dimple 224 at a middle portion thereof, and a soldering material 20 such as a soldering ball is retained in the recess 224.

Figure 4A:
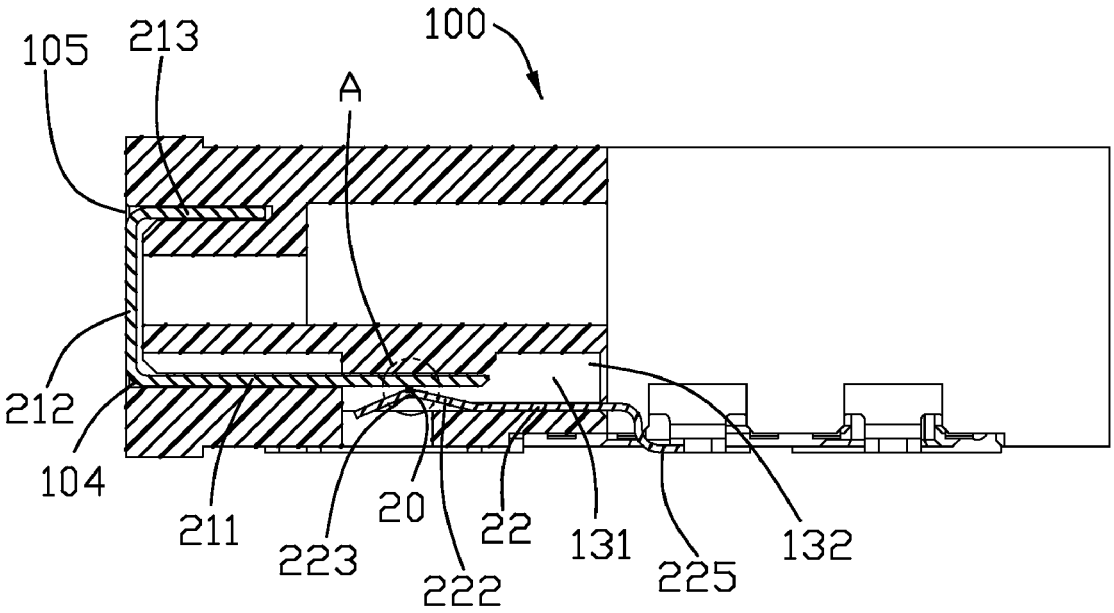
FIGS. 4A-4D are cross sectional views taken along line 4-4 of FIG. 1, and the FIG. 4A shows the soldering ball sandwiched between the connecting portion and the contacting portion in a normal state, the FIG. 4B is an enlarged view of the portion encircled in FIG. 4A, the FIG. 4C shows the soldering ball melted and soldered the two parts together and the FIG. 4D is an enlarged view of the portion encircled in FIG. 4C.
Figure 4B:
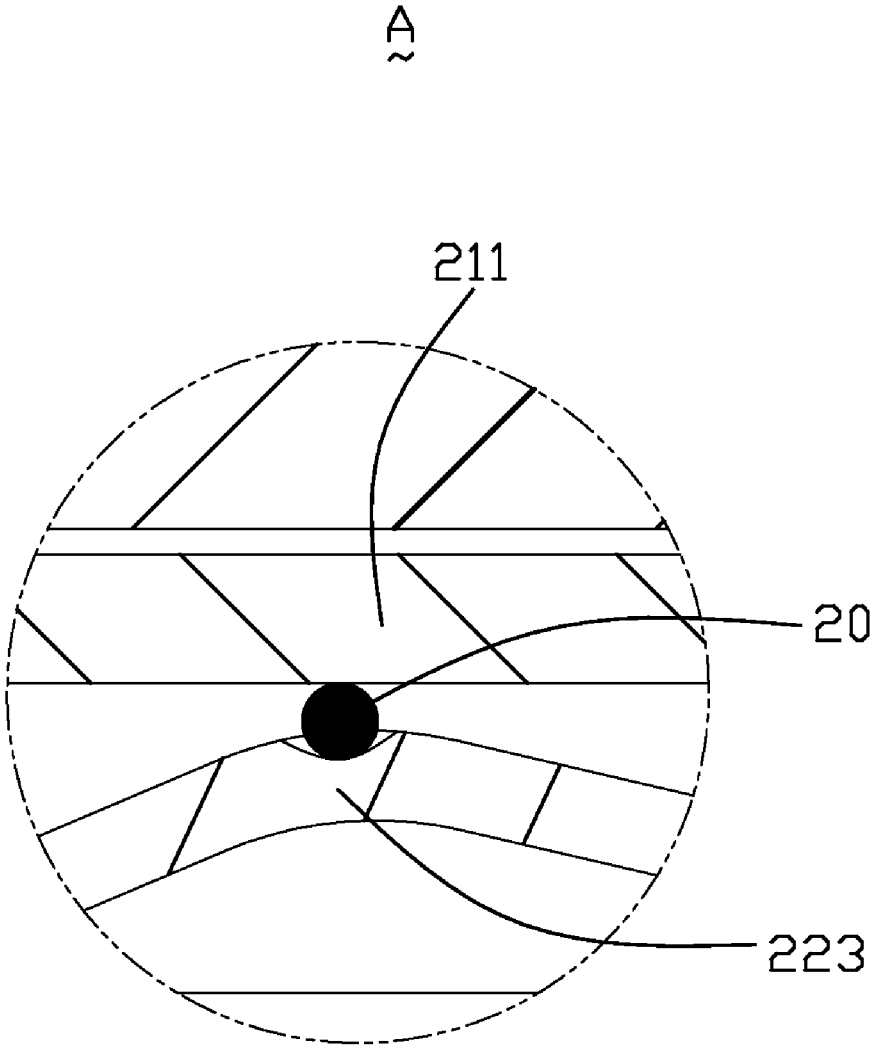
Figure 4C:
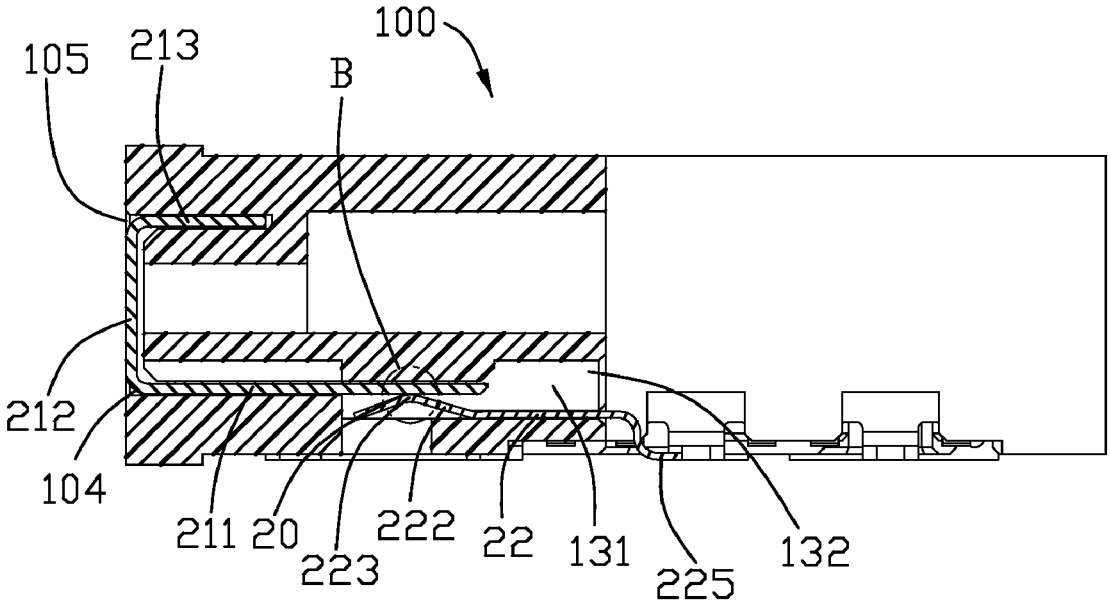
Figure 4D:
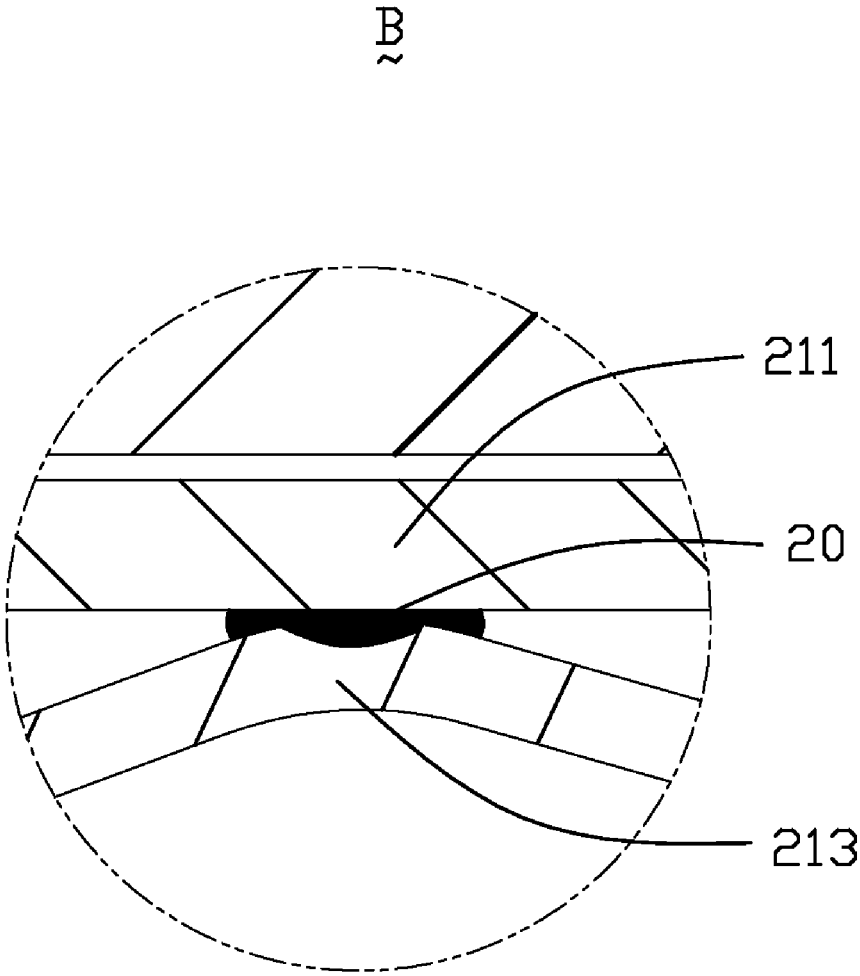

Referring to FIG. 2, FIG. 4A and FIG. 4B, the contacting contact 21 is assembled into the first receiving groove 101 from the mating face 10 and is retained thereto with the connecting portion 211 retained in the retaining slot 104 and the fixing portion 213 retained in the retaining groove 105, and the mating portion 212 is exposed to the mating face 10 to mate with a mating connector. The connecting portion 211 further extends into the receiving portion 132. The soldering contact 22 is assembled into the second receiving groove from the first rear face 13, and the base portion 220 is received and retained in the retaining portion 131 and the resilient arm 222 extends into the receiving portion 132, the soldering portion 225 extends out of the housing for connecting with the PCB. The contacting portion 223 holding the soldering ball 20 thereon is disposed under the connecting portion 211 and projects towards the connecting portion 211 so as to make the soldering ball 20 in contact with the connecting portion 211, and the soldering ball 20 is sandwiched between the contacting portion 223 and the connecting portion 211. The assembly of the pair of the first contacts 2 and the housing 1 is defined as a connector for mating with a first mating connector.

Figure 3:
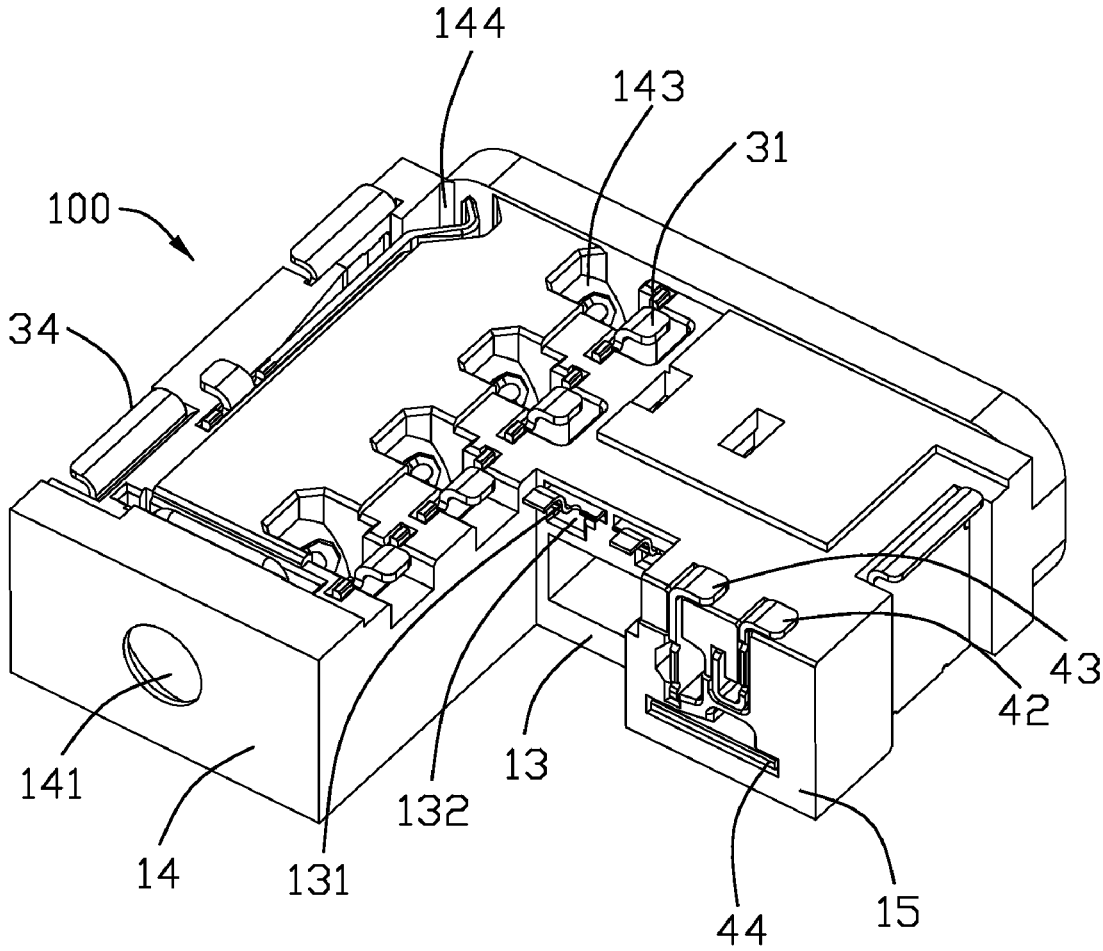
FIG. 3 is another perspective view of the electrical connector shown in FIG. 1.

Referring to FIG. 1 to FIG. 3, the plurality of contacts include four second contacts 31 of similar configuration and arranged in one side of the first receiving cavity 102 and a detecting pair including a movable contact 32 and an immovable contact 33 cooperating with each other. Each of the second contact 31 defines a main portion 310 with bars at lateral sides thereof, a soldering portion 311 extending to the mounting face from the main portion 310 and bending outwards, and a resilient arm 312 extending upwards and then bending downwards. The four contacts 31 are received in the corresponding grooves 143 from the mounting face and with a contacting portion 313 projecting into the first receiving cavity 102. The immovable contact 33 is retained in a corresponding groove 110 and the movable contact 32 is received in a groove 144 with a contacting portion 324 projecting into the first receiving cavity 102. A clip member 35 is of substantial arc-shape, is retained in the housing 1 with a pair of clipping arms 352 projecting into the first receiving cavity 102 for clipping onto a second mating connector. The four second contacts 31, the detecting pair and the clip member 35 assemble around the first receiving cavity 102 to provide an audio jack connector, which can mate with the second mating connector.

Referring to FIG. 1 to FIG. 3, the plurality of contacts include a central contact 42 defining a cylindrical contacting portion 422 at a front portion thereof and a grounding contact 43. The central contact 42 is assembled to the housing 1 from the third rear face 15, and the contacting portion 422 projects into the second receiving cavity 103 to contact a third mating connector. The grounding contact 43 is retained in one side of the second receiving cavity 103 with an elastic arm 432 disposed in the second receiving cavity 103 for contacting with the third mating connector. A retaining part 44 is retained and located above the second receiving cavity 103 with a resilient arm 441 extending into the second receiving cavity 103, which can provide a large retaining force for retaining the third mating connector in the second receiving cavity 103. The central contact 42, the grounding contact 43 and the retaining part 44 assemble around the second receiving cavity 103 to provide a power jack connector, which can mate with the third mating connector. The pair of retaining members 34, 41 is separately retained in the two sidewalls 11, 12 of the housing 1 to reinforce the connection between the connector and the PCB.

Referring to FIG. 4A to FIG. 4D, during soldering the electrical connector to the PCB, the soldering ball 20 will be melted by the heat transferred from the soldering portion 25 to solder the contacting portion 223 and the connecting portion 211 together and steadily, so as to provide a secured and permanent connection between the contacting contact 21 and the soldering contact 22 and prevent the contacting contact 21 and the soldering contact 22 from disconnection by incidentally, which can provide a good and reliable electronic capability for the electrical connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a mating face, a rear face opposite to the mating face, a first receiving groove defined into the mating face and a second receiving groove defined into the rear face, and the two receiving grooves extending towards each other to communicate with each other; and a first contact including a contacting contact retained in the first receiving groove and a soldering contact separated from the contacting contact and retained in the second receiving groove, and the contacting contact defining a mating portion exposed to the mating face, and the soldering contact defining a soldering portion exposed out of the housing for mounting onto a printed circuit board and a resilient arm extending into the second receiving groove and soldered to the contacting contact;

the contacting contact defines a connecting portion bending rearwards from a lower side of the mating portion to be retained in the first receiving groove and further extending into the second receiving groove, and the resilient arm is soldered to the connecting portion;

the resilient arm defines a contacting portion bending towards the connecting portion at a free end thereof and holding a soldering ball thereon, and the soldering ball is sandwiched between the contacting portion and the connecting portion and melted to solder the two portions together while the soldering portion being soldered to the printed circuit board.

2. The electrical connector as described in claim 1, further defining a plurality of second contacts, and the housing further defines a first receiving cavity defined into the mating face, and the second contacts retained around the first receiving cavity with contacting portions projecting into the first receiving cavity.

3. The electrical connector as described in claim 2, further defining a central contact having a cylindrical contacting portion, and the housing further defines a second receiving cavity defined into the mating face, and the central contact is retained to the housing with the contacting portion extending into the second receiving cavity.

4. The electrical connector as described in claim 1, wherein; the connector is allowed to mate with three different types of mating connectors.

5. The electrical connector as described in claim 4, wherein the second receiving groove defines a retaining portion and the receiving portion communicating with the retaining portion, and the connecting portion extends into the receiving groove and the soldering contact is retained in the retaining portion with the resilient arm extending into the receiving portion to solder with the connecting portion.

6. The electrical connector as described in claim 5, wherein; said soldering ball is pre-fused to the second arm before fused to the first arm.

7. The electrical connector as described in claim 6, wherein the contacting contact defines a fixing portion bending rearwards from an upper side of the mating portion and retained in the housing.

8. The electrical connector as described in claim 7, wherein the first receiving groove defines a retaining groove adjacent to the top face, and the fixing portion is parallel to the connecting portion and is retained in the retaining groove.

9. An electrical connector comprising:

an insulative housing defining a mating face and at least one receiving groove defined into the mating face; and a second receiving groove defined into the rear face, and the two receiving grooves extending towards each other to communicate with each other;

a first contact including a contacting contact retained in the first receiving groove and a soldering contact separated from the contacting contact and retained in the second receiving groove, and the contacting contact defining a mating portion exposed to the mating face, and the soldering contact defining a soldering portion exposed out of the housing for mounting onto a printed circuit board and a resilient arm extending into the second receiving groove and soldered to the contacting contact;

the contacting contact defines a connecting portion bending rearwards from a lower side of the mating portion to be retained in the first receiving groove and further extending into the second receiving groove, and the resilient arm is soldered to the connecting portion;

the resilient arm defines a contacting portion bending towards the connecting portion at a free end thereof and holding a soldering ball thereon, and the soldering ball is sandwiched between the contacting portion and the connecting portion and melted to solder the two portions together while the soldering portion being soldered to the printed circuit board.

10. The electrical connector as described in claim 9, wherein; the contacting contact defines a fixing portion bending rearwards from an upper side of the mating portion and retained in the housing.

11. The electrical connector as described in claim 10, wherein; the second receiving groove defines a retaining portion and the receiving portion communicating with the retaining portion, and the connecting portion extends into the receiving groove and the soldering contact is retained in the retaining portion with the resilient arm extending into the receiving portion to solder with the connecting portion.

12. The electrical connector as described in claim 11, wherein; the contacting contact defines a fixing portion bending rearwards from an upper side of the mating portion and retained in the housing.

13. The electrical connector as described in claim 12, further defining a plurality of second contacts, and the housing further defines a first receiving cavity defined into the mating face, and the second contacts retained around the first receiving cavity with contacting portions projecting into the first receiving cavity.

14. The electrical connector as described in claim 13, further defining a central contact having a cylindrical contacting portion, and the housing further defines a second receiving cavity defined into the mating face, and the central contact is retained to the housing with the contacting portion extending into the second receiving cavity.

15. An electrical connector, comprising:

an insulative housing defining a mating cavity and at least a passageway extending from the mating cavity;

at least one contact assembled into the housing and including a first part having a first arm extending into the passageway from one direction, and a second part including a second arm inserted into the passageway from opposite direction and juxtaposed together; and a solder mass arranged between the first and second arms;

the first and second arms are soldered together when the solder mass is melted;

the first arm is supported by the housing and functions as a stiff matter while the second arm is essentially deflectable before soldered to the first arm via said solder mass.

16. The electrical connector as described in claim 15, wherein; a first receiving groove defined into the mating face and a second receiving groove defined into the rear face, and the two receiving grooves extending towards each other to communicate with each other.

17. The electrical connector as described in claim 15, wherein; the second arm defining a soldering portion exposed out of the housing for mounting onto a printed circuit board.

18. The electrical connector as described in claim 17, wherein said solder mass is pre-fused to the second arm before fused to the first arm.

19. The electrical connector as described in claim 18, wherein a position of the second arm, where the solder mass is pre-fused, defines a deflected angle.

20. The electrical connector as described in claim 18, wherein said second arm defines a recess in which the solder mass is at least partially disposed.

* * * * *